US005218163A

United States Patent [19]

Dabrowski

[11] Patent Number: 5,218,163

[45] Date of Patent: Jun. 8, 1993

[54] PRESSURE RELIEF MECHANISM FOR GAS OPERATED FIREARM

[75] Inventor: Gary P. Dabrowski, Naugatuck, Conn.

[73] Assignee: O.F. Mossberg & Sons, Inc., North Haven, Conn.

[21] Appl. No.: 850,565

[22] Filed: Mar. 13, 1992

[51] Int. Cl.[5] ..... F41A 5/26

[52] U.S. Cl. ..... 89/193

[58] Field of Search ..... 89/191.02, 193

[56] References Cited

U.S. PATENT DOCUMENTS 3,968,727 7/1976 Hyytinen ..... 89/193
4,872,392 10/1989 Powers et al. ..... 89/193
4,901,623 2/1990 Lee ..... 89/193

FOREIGN PATENT DOCUMENTS 605735 6/1960 Italy ..... 89/193

*Primary Examiner*—Stephen C. Bentley
*Attorney, Agent, or Firm*—McCormick, Paulding & Huber

[57] ABSTRACT

A gas operated auto loading shotgun having an axially elongate magazine tube and a gas operated piston/cylinder coaxially surrounding the magazine tube includes a gas pressure relief mechanism at the forward end of the gas cylinder for venting gases of combustion in a forward direction toward the muzzle end of the gun when gas pressure within the gas cylinder exceeds a predetermined magnitude. The pressure relief mechanism includes two angularly spaced apart vent ports communicating with the interior of the gas cylinder and terminating at valve seats at the forward end of the gas cylinder. Spherical valve elements seated on the valve seats are biased toward the valve seats by an annular flat spring member secured in fixed on the gas cylinder by a single fastener and surrounding an associated portion of the magazine tube.

21 Claims, 2 Drawing Sheets

PRESSURE RELIEF MECHANISM FOR GAS OPERATED FIREARM

BACKGROUND OF THE INVENTION

This invention relates in general to firearms and deals more particularly with an improved pressure relief mechanism for a gas operated auto loading firearm. More specifically, the present invention is concerned with an improved automatic gas pressure control system for an auto loading shotgun which will accommodate any 2 or 3 inch commercial ammunition. The ammunition used with such a gun may be lead or steel shot, buckshot or slugs.

Heretofore, various gas relief mechanisms have been provided for auto loading firearms. An example of such a gas relief system is found in U.S. Pat. No. 4,901,623 to Lee for Compensating Device For Gas Actuated Firearms, assigned to the assignee of the present invention. The Lee compensating device is designed primarily for use on a gas operated auto loading shotgun loaded from a magazine tube and vents gases of explosion from a gas cylinder and in a forward direction or toward the muzzle end of the gun when gas pressure within the gas cylinder, which operates the action, exceeds a predetermined magnitude. The Lee device includes a rigid annular valve element encircling the magazine tube and supported by a plurality of parallel guide members or rods for axial movement along the guide members and toward and away from a complementary annular valve seat defined by the gas cylinder. Springs associated with the guide members bias the valve element toward and into seating engagement with the valve seat to form a closure for one or more vent ports which communicate with the interior of the gas cylinder and open through the valve seat. Preferably, the Lee device has at least three equangularly spaced apart vent ports which assure smooth axial movement of the valve element along and relative to the guide members without binding in response to the escape of gas under pressure from the gas cylinder. While the Lee compensating device provides satisfactory venting to control gas cylinder pressure, it has a large number of parts and is relatively expensive to manufacturer.

Accordingly, it is the general aim of the present invention to provide an improved forwardly vented gas pressure relief system for a firearm which enables a wide range of ammunition to be used in the firearm without requiring barrel change or adjustment of the system and which reduces the number of parts required to make such a system.

SUMMARY OF THE INVENTION

In accordance with the present invention an improved pressure relief system is provided for a firearm having a receiver, a barrel connected to and projecting forwardly from the receiver and including a bore, a breech bolt supported within the receiver for reciprocal movement between battery and retired positions, and gas operated mechanism for operating the action to move the breech bolt from its battery to its retired position in response to gases of explosion produced by discharging the firearm. The gas operated mechanism includes a gas cylinder mounted generally adjacent the barrel, a piston supported for movement relative to the gas cylinder and cooperating with the gas cylinder to define a gas chamber of variable volume, and means for defining a bleed port communicating with the bore and with the gas chamber. The improved pressure relief system comprises at least one gas vent port defined by the gas cylinder, communicating with the gas chamber and terminating at a valve seat at the forward end of the gas cylinder, a resilient member, attaching means for securing an associated portion of the resilient member in fixed position to the gas cylinder and in spaced relation to the valve seat. The resilient member has a portion thereof spaced from the attaching means and extending across the valve seat. A means for providing a closure for the vent port is disposed between the resilient member and the valve seat and biased toward the valve seat by the resilient member.

DETAILED DESCRIPTION OF PREFERRED EMBODIMENT

Figure 1:
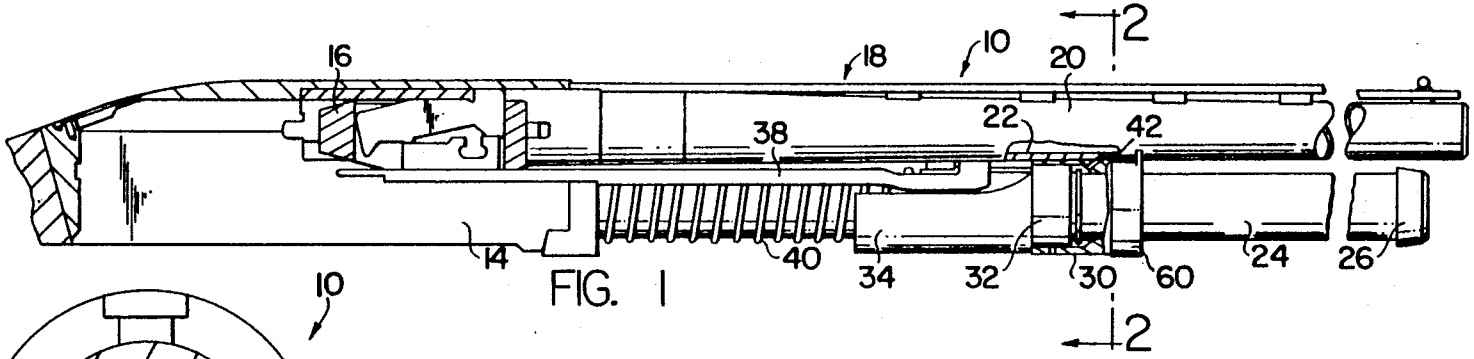
FIG. 1 is a fragmentary side elevational view of a firearm embodying the present invention shown partially in axial section.
Figure 2:
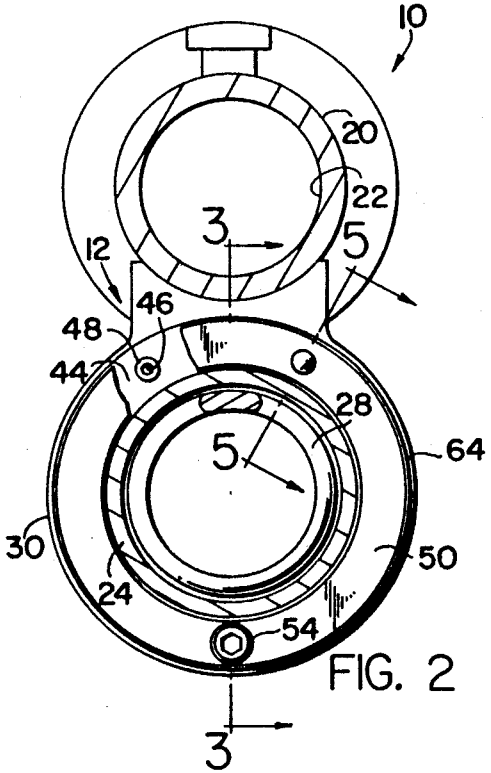
FIG. 2 is a somewhat enlarged sectional view taken along the line 2—2 of FIG. 1.

Turning now to the drawings, a gas operated auto loading firearm or shotgun embodying the present invention is indicated generally by the reference numeral 10. The illustrated shotgun 10 is a modified MOSSBERG Model 5500 12 gauge shotgun, manufactured and marketed by O.F. Mossberg & Sons, Inc., North Haven, Conn., assignee of the present invention. Specifically, the shotgun 10 has a modified barrel assembly which includes an improved gas pressure relief mechanism embodying the invention and indicated generally by the numeral 12. Parts of the shotgun 10 not essential to an understanding of the invention have been omitted for the clarity of illustration.

Considering the shotgun 10 in further detail, it has a receiver 14 supporting a breech bolt 16 for movement between battery and retired positions. In FIG. 1 the breech bolt is shown locked in battery position. A barrel assembly indicated generally at 18 is releasably secured to and projects forwardly from the receiver and includes a barrel 20 which defines a bore 22. A generally cylindrical magazine tube 24 connected to the receiver 14 below the barrel 20 projects forwardly from the receiver in generally axially parallel relation to the barrel. The magazine tube 24 is closed at its forward end by a conventional magazine cap 26 which is releasably secured to the forward end of the magazine tube 24 and also retains a forearm (not shown). A magazine spring 28 contained within the magazine tube urges successive shot shells from the magazine tube to a loading position within the receiver 14 and into alignment with an elevator (not shown).

The gas operated auto loading mechanism for operating the action includes an annular gas cylinder 30 which comprises a part of the barrel assembly 18 and which is mounted in fixed position on the barrel 20 forward of the receiver and in coaxial surrounding relation to an associated portion of the magazine tube 24. A piston assembly which includes a generally cylindrical piston 32 and an inertia weight 34 is supported for coaxial sliding movement on and along the magazine tube. The piston 32 extends into the rearwardly open gas cylinder 30 and cooperates with the gas cylinder 30 and with an associated portion of the magazine tube 24 to define a gas chamber of variable volume, indicated by the numeral 36 in FIG. 3.

The gas operated mechanism further includes an action bar assembly, indicated generally at 38, which connects the breech bolt 16 to the piston assembly to move in response to movement of the piston assembly. The piston 32 is biased in the direction of the gas cylinder 30 by a spring 40 which acts between the piston assembly and the receiver 14, substantially as shown in FIG. 1. Gases of explosion produced within the shell chamber (not shown) when a shell is fired in the gun 10 enter the gas chamber 36 through a gas bleed port indicated at 42 shown in FIG. 1 and defined in part by the barrel 20 and in part by the gas cylinder 30, all of which is well known in the shotgun art.

Figure 5:
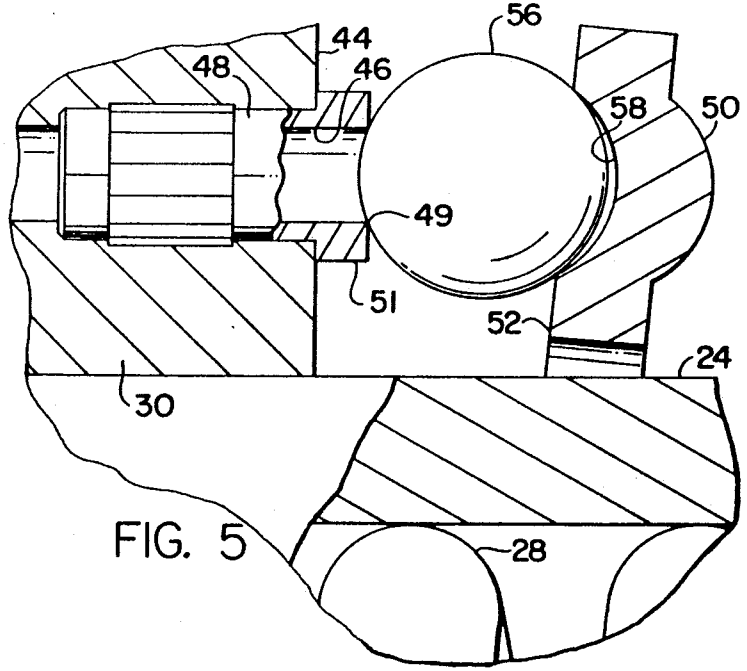
FIG. 5 is a somewhat enlarged fragmentary sectional view taken along the line 5—5 of FIG. 2.
Figure 3:
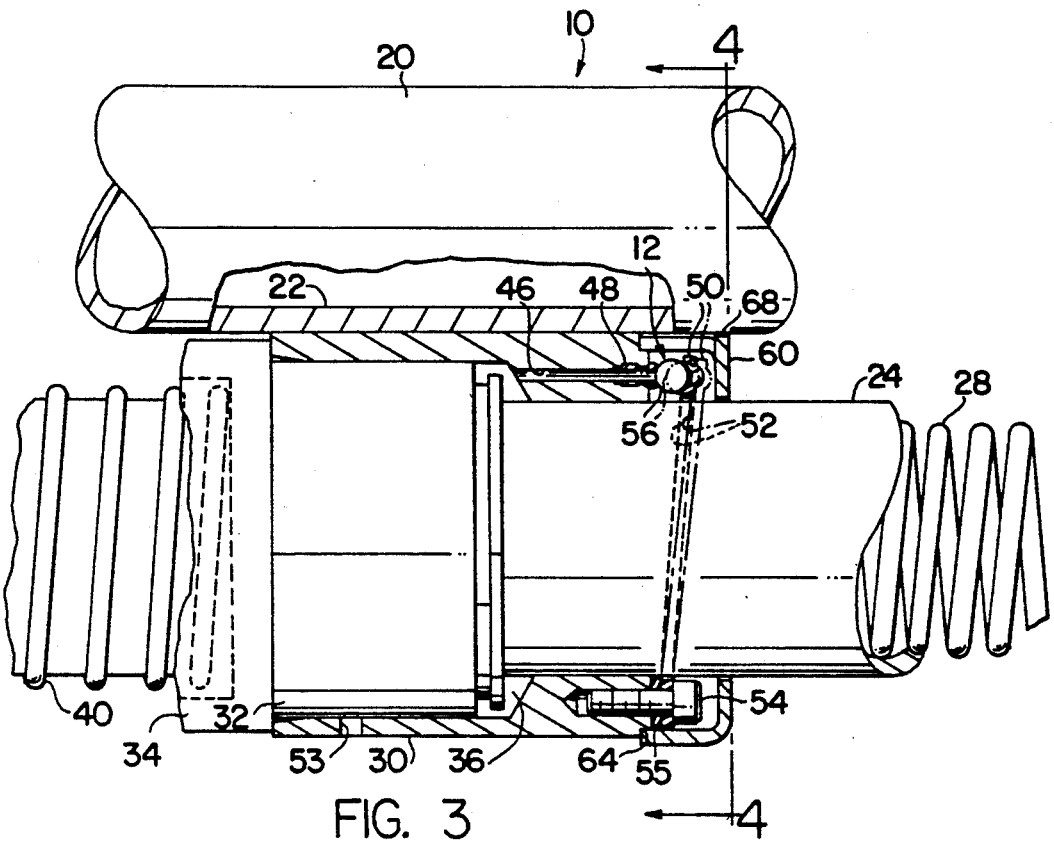
FIG. 3 is a fragmentary view shown partially in section taken generally along the line 3—3 of FIG. 2.
Figure 4:
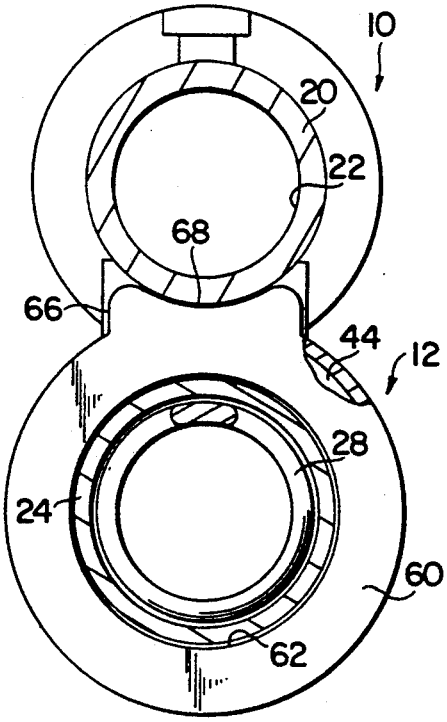
FIG. 4 is a sectional view taken along the line 4—4 of FIG. 3.
Figure 6:
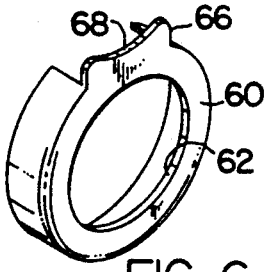
FIG. 6 is a perspective view of the cover for the gas pressure relief mechanism.

Referring now particularly to FIGS. 2–5, and further considering the gas pressure relief mechanism 12, the gas cylinder 30 has a generally radially disposed and forwardly facing frontal surface 44 which coaxially surrounds the magazine tube 24. At least one gas vent port 46 defined by the gas cylinder 30 communicates with the gas chamber 36 and opens outwardly through the frontal surface 44, but preferably, and as shown, two cylindrical gas vent ports indicated at 46,46 are provided. Preferably each gas vent port 46 is at least partially defined by a splined hardened metal insert 48 press fitted within an associated aperture in the gas cylinder 30. Each insert 48 defines an annular valve seat 49 and has an annular flange 51 which is seated on the surface 44, as best shown in FIG. 5. The illustrated gas vent ports 46,46 are angularly spaced apart about the axis of the magazine tube 24, one port being located proximate the eleven o'clock position and the other port being located proximate the one o'clock position, as viewed Preferably, at least one secondary vent port, such as the vent port 53 shown in FIG. 3, is formed in the gas cylinder 30 and communicates with the interior of the cylinder near the rear end of the cylinder.

The gas pressure relief mechanism 12 further includes an arcuate resilient member or flat spring mounted on the gas cylinder 30. The illustrated spring 50 has an arcuate configuration and preferably comprises a generally circular ring which has a substantially flat generally radially disposed rear surface 52 and coaxially surrounds the magazine tube 24 forward of the gas cylinder 30. The inside diameter of the circular flat spring member 50 is somewhat larger than the outside diameter of the magazine tube 24. An associated portion of the flat spring 50 is secured in fixed position to the gas cylinder 30. Preferably, and as shown, the spring 50 is secured to the gas cylinder in spaced relation to the frontal surface 44 by a single threaded fastener 54 and a spacer 55. The fastener passes through an aperture in the spring member 50 and the spacer 55 and is threadably engaged within an associated threaded opening in the gas cylinder 30, as best shown in FIG. 3.

The illustrated gas vent ports 46,46 are respectively closed by valve elements 56,56. The valve elements may take various forms but preferably, and as shown, the illustrated valve elements comprise individual members or spherical balls. Each ball 56 is preferably made from metal and partially received within an associated gas vent port 46 and seated upon an associated valve seat 49. Each ball 56 is resiliently biased toward an associated valve seat 49 by the spring member 50 and engages the valve seat along a circular line of contact. A pair of rearwardly open generally semi-spherical ball receiving pockets 58,58 are formed in the resilient spring member 50 and in registry with the gas release ports 46,46. Each pocket 58 receives a portion of an associated ball 56 therein. Thus, each sealing ball 56 is disposed between and partially received within an associated gas vent port 46 and a ball receiving pocket 58. In this manner spherical balls 56,56 are retained in operative assembly relative to the gas cylinder 30.

A generally rearwardly open cup-shaped cover 60 which has a circular opening 62 in its front wall is received on the magazine tube 24 and assembled in press fit engagement with the gas cylinder 30 within a forwardly and radially outwardly open annular recess 64 formed in the gas cylinder. The cover 60 cooperates with the gas cylinder and the magazine tube to provide a protective enclosure for the pressure relief mechanism 12 and also cooperates with the magazine cap 26 to releasably retain the forearm (not shown) in assembly on the shotgun 10 in a manner well known in the art. An upwardly extending tab 66 struck from the cover 60 provides an opening in the cover below the barrel 20 to facilitate escape of gas from the cover 60 and toward the lower surface of the barrel. The tab 66 has an upper edge 68 which complements an associated portion of the barrel 20 to assure proper orientation of the cover 60 relative to the barrel 20 when the cover is assembled with the gas cylinder 30.

When the shotgun 10 is discharged, gases, the result of combustion, under pressure, migrate from the barrel 20 into the gas chamber 36 as a projectile or shot load passes the bleed port 42. Gases of combustion, under pressure, enter and fill the initial space or volume of the gas chamber 36. The expanding gases act against all surfaces which define this initial volume including the front face of the annular piston 32 and portions of the surfaces of the sealing balls 56,56 which form the closures for the vent ports 46,46. If pressure within the gas chamber 36 exceeds a predetermined magnitude, generally a pressure somewhat greater than that which is necessary to operate the action, the balls 56,56 will unseat allowing the harmless escape of gas from the gas chamber 36 through the vent ports 46,46 and into the space within the cover 60 and from the cover toward the underside of the barrel 20. The gas release mechanism 12 operates substantially instantaneously to reduce pressure within the gas cylinder, therefore, the risk of damage to the action resulting from excess operating pressure is alleviated. The unseating movement of the balls 56,56 is very slight, because gas pressure within the gas cylinder 30 rapidly reaches ambient pressure. Operation of the device drives each sealing ball 56 toward its respectively associated ball receiving pocket 58, therefore, each sealing ball will remain in position between the spring member 50 and its respective associated valve seat 49.

The secondary vent port or ports 53 located near the rear of the gas cylinder further regulate the system, as required, based on the ammunition type used. The net result is that the velocity of the dynamic assembly which includes the breech bolt, action bar assembly and piston assembly is controlled within predetermined limits to provide a gun having a smoothly operable action and which is comfortable to shoot.

I claim:

1. In a gas operated firearm having a receiver, a barrel having a bore and connected to and projecting forwardly from the receiver, a breech bolt supported within the receiver for reciprocal movement between battery and retired positions, gas operating mechanism for moving the breech bolt from its battery to its retired position in response to pressure exerted by gases of combustion produced by discharging the firearm and including a gas cylinder mounted generally adjacent the barrel, a piston supported for movement relative to the gas cylinder and cooperating with the gas cylinder to define a gas chamber of variable volume, and means defining a gas bleed port communicating with the bore and with the gas chamber, and pressure relief means for venting gases of explosion from the gas chamber when gas pressure within the gas chamber exceeds a predetermined magnitude, the improvement wherein said gas cylinder has a generally radially disposed and forwardly facing frontal surface and said pressure relief means comprises a gas vent port opening through said frontal surface and communicating with said gas chamber, said gas vent port terminating at a valve seat at the forward end of said gas cylinder, valve means for seating engagement with said valve seat to close said vent port, and means for biasing said valve means toward and into seating engagement with said valve seat and including a resilient arcuate member having a rearwardly facing surface, attaching means for securing an associated portion of said resilient arcuate member in fixed position to said forward end in spaced relation to said valve seat and with said rearwardly facing surface disposed in generally opposing relation to said forwardly facing surface, said resilient arcuate member having a portion thereof angularly spaced about the axis of said gas cylinder from said attaching means and extending across said valve seat.

2. In a gas operated firearm as set forth in claim 1 wherein the firearm includes a magazine tube and the gas cylinder coaxially surrounds the magazine tube the further improvement wherein said resilient arcuate member comprises an annular flat spring encircling the magazine tube.

3. In a gas operated firearm as set forth in claim 1 the further improvement wherein said valve means comprises a valve member disposed between said valve seat and said resilient arcuate member.

4. In a gas operated firearm as set forth in claim 3 the further improvement comprising retaining means for maintaining said valve member between said valve seat and said resilient means.

5. In a gas operated firearm as set forth in claim 4 the further improvement wherein said retaining means comprises an opening in said resilient means receiving an associated portion of said valve member therein.

6. In a gas operated firearm as set forth in claim 5 the further improvement wherein said sealing member comprises a spherical ball and said opening is defined by a ball receiving pocket formed in said resilient means.

7. In a gas operated firearm as set forth in claim 1 the further improvement wherein said attaching means comprises a single fastener.

8. In a gas operated firearm as set forth in claim 7 the further improvement wherein said resilient member comprises a flat spring and said single fastener extends through said associated portion and is threadably engaged in said gas cylinder.

9. In a gas operated firearm as set forth in claim 1 the further improvement wherein said pressure relief means includes an insert received within said gas cylinder and defining said valve seat and at least a portion of said gas vent port.

10. In a gas operated firearm as set forth in claim 9 the further improvement wherein said valve means engages said valve seat along a circular line of contact.

11. In a gas operated firearm as set forth in claim 10 wherein said valve means comprises a spherical ball.

12. In a gas operated firearm as set forth in claim 11 wherein said insert has an annular fringe engaging said front surface.

13. In a firearm as set forth in claim 12 the further improvement wherein said resilient member is secured to said gas cylinder in spaced relation to said frontal surface by said attaching means.

14. In a gas operated auto loading firearm having a receiver, an axially elongate barrel connected to and projecting axially forward from the receiver and having a bore, a cylindrical magazine tube connected to and projecting forwardly from the receiver in axially parallel relation to the barrel, a breech bolt supported within the receiver for reciprocal movement between battery and retired positions, gas operating means for moving the breech bolt from its battery to its retired position in response to gases of combustion produced by discharging the firearm and including a gas cylinder mounted adjacent the barrel in generally coaxial surrounding relation to an association portion of the magazine tube, a piston supported for sliding movement on and along the magazine tube and extending into the gas cylinder, the gas cylinder cooperating with the piston and an associated portion of the magazine tube to define a gas chamber of variable volume, means defining a gas bleed port for the passage of gases of explosion from the bore to the gas chamber, and action bar means for providing connection between the breech bolt and the piston to move the breech bolt in response to movement of the piston, and pressure relief means for venting gases of explosion from the gas chamber when the pressure in the gas chamber exceeds a predetermined magnitude, the improvement wherein said pressure relief means comprises a generally radially disposed and forwardly annular facing frontal surface on the forward end of said gas cylinder coaxially encircling said magazine tube, means defining a plurality of gas vent ports communicating with said gas chamber and opening through said frontal surface, said gas vent ports terminating at valve seats at the forward end of said gas cylinder, said valve seats being angularly spaced apart about the axis of said frontal surface, a resilient annular flat spring member encircling said magazine tube forward of said gas cylinder and having a generally radially disposed rear surface, attaching means for securing to said gas cylinder an associated portion of said resilient member angularly spaced from said valve seats, and valve members disposed between said valve seats and said resilient member and biased into seating engagement with said valve seats by said resilient member.

15. In a gas operated firearm as set forth in claim 14 the further improvement wherein said pressure relief means includes a plurality of inserts received within said gas cylinder, each of said inserts defining a portion of an associated one of said gas vent ports and an associated one of said valve seats and said valve members comprise spherical balls.

16. In a gas operated firearm as set forth in claim 14 the further improvement wherein said pressure relief means has two gas vent ports equangularly spaced in opposite directions from said attaching means.

17. In a gas operated firearm as set forth in claim 16 the further improvement wherein said attaching means comprises a single fastener.

18. In a gun barrel assembly having a barrel including an axially elongate bore and a muzzle at the forward end thereof, a gas cylinder mounted in fixed position on the barrel in axially parallel relation to the bore for cooperating with a magazine tube and a piston to define a gas chamber of variable volume, the gas chamber having an annular front wall including an annular frontal surface, the front wall defining a cylindrical opening for receiving a magazine tube therethrough, means defining a gas bleed port communicating with the bore and with the interior of the gas cylinder, and gas pressure relief means for venting gases of combustion from said gas cylinder when gas pressure within the gas cylinder exceeds a predetermined magnitude, the improvement wherein said gas pressure relied means comprises at least one gas vent port defined by said gas cylinder and communicating with the interior thereof, said gas vent port terminating at a valve seat at the forward end of said gas cylinder, a spherical ball engagable with said valve seat for closing said vent port, and a flat spring member secured in fixed position to said front wall at a location angularly spaced from said valve seat, said spring member having an arcuate shape substantially complementing the shape of at least an associated portion of said frontal surface, and having a ball receiving pocket formed therein receiving said spherical ball and retaining said spherical ball between said resilient member and said valve seat, said resilient member biasing said spherical ball toward and into seating engagement with said valve seat.

19. In a barrel assembly as set forth in claim 18 the further improvement wherein said flat spring comprises an annular spring having a circular opening therein for receiving a magazine tube therethrough.

20. In a barrel assembly as set forth in claim 18 the further improvement wherein said spring member is secured in said fixed position by a single fastener.

21. In a gas operated firearm having a receiver, a barrel having a bore and connected to and projecting forwardly from the receiver, a breech bolt supported within the receiver for reciprocal movement between battery and retired positions, gas operating mechanism for moving the breech bolt from its battery to its retired position in response to pressure exerted by gases of combustion produced by discharging the firearm and including a gas cylinder mounted generally adjacent the barrel, a piston supported for movement relative to the gas cylinder and cooperating with the gas cylinder to define a gas chamber of variable volume, and means defining a gas bleed port communicating with the bore and with the gas chamber, and pressure relief means for venting gases of explosion from the gas chamber when gas pressure within the gas chamber exceeds a predetermined magnitude, the improvement wherein said pressure relief means comprises a gas vent port opening through said gas cylinder and communicating with said gas chamber, said gas vent port terminating at a valve seat at the forward end of said gas cylinder, a resilient member, attaching means for securing an associated portion of said resilient member in fixed position to said forward end in spaced relation to said valve seat, said resilient member having a portion thereof spaced from said attaching means and extending across said valve seat, a spherical ball disposed between said valve seat and said resilient member and biased toward said valve seat by said resilient means for closing said vent port and retaining means for maintaining said spherical ball between said valve seat and said resilient member and comprising an opening in said resilient member defined by a ball receiving pocket formed in said resilient member and receiving an associated portion of said spherical ball therein.

* * * * *